US009594320B2

(12) United States Patent
Fukatsu et al.

(10) Patent No.: US 9,594,320 B2
(45) Date of Patent: Mar. 14, 2017

(54) TONER AND METHOD OF PRODUCING THE TONER

(71) Applicant: CANON KABUSHIKI KAISHA, Tokyo (JP)

(72) Inventors: Makoto Fukatsu, Suntou-gun (JP); Manami Haraguchi, Yokohama (JP); Atsushi Nakamoto, Tokyo (JP); Kazunari Hagiwara, Yokohama (JP); Tatsuaki Orihara, Tokyo (JP); Shuhei Tokiwa, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/737,933

(22) Filed: Jun. 12, 2015

(65) Prior Publication Data

US 2015/0378271 A1 Dec. 31, 2015

(30) Foreign Application Priority Data

Jun. 25, 2014 (JP) ..... 2014-130690

(51) Int. Cl.
*G03G 9/08* (2006.01)
*G03G 9/087* (2006.01)

(52) U.S. Cl.
CPC ..... *G03G 9/0825* (2013.01); *G03G 9/0804* (2013.01); *G03G 9/0827* (2013.01); *G03G 9/08704* (2013.01)

(58) Field of Classification Search
CPC . G03G 9/0827; G03G 9/08704; G03G 9/0825
(Continued)

(56) References Cited

U.S. PATENT DOCUMENTS 5,087,677 A 2/1992 Brekner et al.
5,268,248 A 12/1993 Tanikawa et al.
(Continued)

FOREIGN PATENT DOCUMENTS

EP 0 156 464 A1 10/1985
EP 0 203 799 A1 12/1986
(Continued)

OTHER PUBLICATIONS

English language translation of JP 58-149060 (Sep. 1983).*
English language machine translation of JP 2007-298869 (Nov. 2007).*

*Primary Examiner* — Christopher Rodee
(74) *Attorney, Agent, or Firm* — Fitzpatrick, Cella, Harper & Scinto

(57) ABSTRACT

Provided is a toner, including a toner particle having a core particle containing a binder resin and a colorant. The toner particle has a protrusion on a surface thereof, and the protrusion contains an olefin-based polymer having a cyclic olefin structure. When an average radius of curvature of the protrusion, an average particle diameter of the core particle, a projected area of the toner particle, and a projected area of the protrusion that are calculated from a planar projected image of an image of the toner particle photographed with a scanning electron microscope are represented by Rs (μm), Rc (μm), S, and S1, respectively, the average radius of curvature Rs of the protrusion is 0.004Rc μm or more and 0.100Rc μm or less, and an average of a surface coverage "100×S1/S" % is 5% or more and 90% or less.

3 Claims, 2 Drawing Sheets

(58) Field of Classification Search
USPC ..... 430/110.3
See application file for complete search history.

(56) References Cited

U.S. PATENT DOCUMENTS

| | | | | |
|---|---|---|---|---|
| 5,331,057 | A | 7/1994 | Brekner et al. | |
| 5,422,409 | A | 6/1995 | Brekner et al. | |
| 5,541,031 | A * | 7/1996 | Yamashita | C08F 2/08 428/402 |
| 5,602,219 | A | 2/1997 | Aulbach et al. | |
| 5,716,746 | A | 2/1998 | Mikuriya et al. | |
| 6,077,638 | A | 6/2000 | Tanikawa et al. | |
| 6,187,496 | B1 | 2/2001 | Tanikawa et al. | |
| 6,790,577 | B1 * | 9/2004 | Nakamura | G03G 9/09328 430/108.8 |
| 7,314,695 | B2 * | 1/2008 | Harada | G03G 9/08704 430/108.22 |
| 7,875,413 | B2 * | 1/2011 | Shibai | G03G 9/09321 430/110.2 |
| 8,518,625 | B2 * | 8/2013 | Fukao | G03G 9/0804 430/108.1 |
| 8,614,040 | B2 * | 12/2013 | Fukao | G03G 21/18 430/108.1 |
| 8,623,581 | B2 * | 1/2014 | Fukao | B82Y 30/00 399/252 |
| 8,835,089 | B2 | 9/2014 | Hagiwara et al. | |
| 8,852,836 | B2 * | 10/2014 | Seki | G03G 5/14786 430/108.3 |
| 2006/0160007 | A1 * | 7/2006 | Kmiecik-Lawrynowicz | G03G 9/0804 430/108.3 |
| 2007/0065745 | A1 * | 3/2007 | Gerroir | G03G 9/09314 430/110.2 |
| 2012/0219321 | A1 * | 8/2012 | Fukao | G03G 9/0827 399/111 |
| 2012/0264048 | A1 * | 10/2012 | Ishikawa | G03G 9/0806 430/124.1 |
| 2013/0236825 | A1 * | 9/2013 | Sweeney | G03G 9/0819 430/108.11 |
| 2014/0038095 | A1 * | 2/2014 | Ishikawa | G03G 9/0819 430/105 |

FOREIGN PATENT DOCUMENTS

| | | | |
|---|---|---|---|
| EP | 0 283 164 | A2 | 9/1988 |
| EP | 0 407 870 | A2 | 1/1991 |
| JP | 58149060 | A * | 9/1983 |
| JP | 5-9223 | A | 1/1993 |
| JP | 5-339327 | A | 12/1993 |
| JP | 6-271628 | A | 9/1994 |
| JP | 2005-195934 | A | 7/2005 |
| JP | 2007298869 | A * | 11/2007 |

* cited by examiner

TONER AND METHOD OF PRODUCING THE TONER

BACKGROUND OF THE INVENTION

Field of the Invention

The present invention relates to a toner to be used in an image forming method involving using an electrophotographic system such as a copying machine, a printer, a facsimile, or a composite machine thereof, and to a method of producing the toner.

Description of the Related Art

In recent years, an image forming apparatus such as an electrophotographic copying machine, which has heretofore merely copied an original, has become widely available as an information output device linked to any other information device in countries all over the world because of its digitization. Accordingly, the number of abilities that a toner is required to have such as high definition, high quality, high image quality, a high speed, and high reliability does not cease to increase. In particular, the toner has been required to provide stable image quality independent of an environment because the variety of environments where the toner is used has expanded in association with market expansion.

For example, it has been known that the chargeability of an electrophotographic toner reduces under a high-humidity environment, and image quality is impaired by an influence of the reduction in some cases. The impairment is specifically, for example, the occurrence of fogging in which the toner is slightly developed in a white portion (non-printing portion) where nothing is intended to be printed, and hence the toner appears like greasing. In addition, when the flowability of the electrophotographic toner reduces, the property by which a developer is supplied is impaired, and hence the image quality is impaired by an influence of the impairment in some cases. For example, when a high-density image is repeatedly output, a density reduces on the rear end side of the image.

Further, from the viewpoint of energy savings by a reduction in power consumption, a mainstream fixing system in an image forming apparatus has started to shift from a conventional hard roller-type system having a large heat capacity to a light-pressure fixing system such as film fixation or belt fixation having a small heat capacity. In the light-pressure fixing system, a reduction in heat capacity of a fixing member has been performed in order to shorten a time period required to reach a fixation set temperature (control temperature), thereby achieving a system that is excellent in quick start property. Because of the reduction in heat capacity of the fixing member, the extent to which the temperature of the fixing member reduces when high-speed continuous copying is performed enlarges as compared with the conventional hard roller-type system. Accordingly, a toner that can be fixed at additionally low temperature is needed, and hence not only an additional improvement in low-temperature fixability but also a wide fixation temperature width (hereinafter sometimes referred to as "fixation latitude") has started to be required as performance that the toner is desired to have.

To satisfy the requirement, a high-flowability toner having high charging stability against a change in hygrothermal environment, i.e., high charging stability against an environment, and having a wide fixation latitude has started to be required more than ever before, and hence various attempts have been proposed. Japanese Patent Application Laid-Open No. 2005-195934 proposes the use of a polyolefin resin having a cyclic structure as the binder resin of a toner. The polyolefin resin having a cyclic structure is colorless and transparent, has a high light transmittance, and has a low moisture absorbing property. Japanese Patent Application Laid-Open No. 2005-195934 describes that when a silicone resin or a fluorine resin is further incorporated into the toner containing the polyolefin resin having a cyclic structure as its binder resin, an electrophotographic color toner excellent in charging stability against an environment, having high color developability, and excellent in low-temperature fixability and flowability can be provided.

SUMMARY OF THE INVENTION

The present invention is directed to providing a toner that has excellent charging stability against an environment, excellent flowability, and a wide fixation latitude, and can provide stable image quality independent of an environment over a long time period, and a method of producing the toner.

According to one aspect of the present invention, there is provided a toner, including a toner particle having a core particle containing a binder resin and a colorant, in which:

the toner particle has a protrusion on a surface thereof;

the protrusion contains an olefin-based polymer having a cyclic olefin structure; and when an average radius of curvature of the protrusion is defined as Rs (μm), an average particle diameter of the core particle is defined as Rc (μm), a projected area of the toner particle is defined as S, and a projected area of the protrusion is defined as S1, the average radius of curvature Rs of the protrusion is 0.004Rc μm or more and 0.100Rc μm or less, and an average of a surface coverage "100×S1/S" % defined as a ratio of the projected area S1 of the protrusion to the projected area S of the toner particle is 5% or more and 90% or less, Rs (μm), Rc (μm), S and S1 being calculated from a planar projected image of an image of the toner particle photographed with a scanning electron microscope.

Further, according to another aspect of the present invention, there is provided a method of producing the above-mentioned toner, including:

(1) producing a first aqueous dispersion liquid containing a resin fine particle having a median diameter on a volume basis of 5 nm or more and 500 nm or less, the resin fine particle containing an olefin-based polymer having a cyclic olefin structure;

(2) producing a second aqueous dispersion liquid containing a core particle;

(3) mixing the first aqueous dispersion liquid and the second aqueous dispersion liquid to adhere the resin fine particle to a surface of the core particle; and (4) heating the mixed dispersion liquid at a temperature equal to or more than a glass transition point of a resin constituting the resin fine particle to stick the resin fine particle to the surface of the core particle to form a toner particle having a protrusion on a surface thereof.

Further features of the present invention will become apparent from the following description of exemplary embodiments with reference to the attached drawings.

DESCRIPTION OF THE EMBODIMENTS

Figure 1:
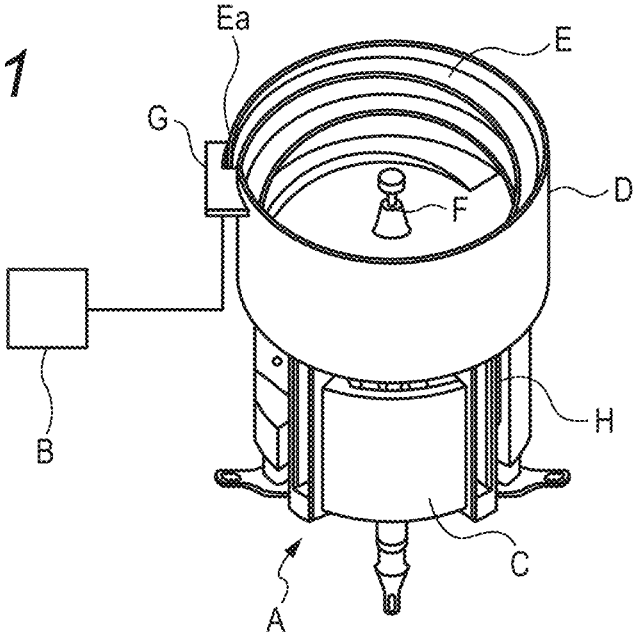
FIG. 1 is a schematic view of a transport property measuring apparatus to be used in the evaluation of a toner of the present invention.

Preferred embodiments of the present invention will now be described in detail in accordance with the accompanying drawings.

The flowability of the toner according to Japanese Patent Application Laid-Open No. 2005-195934 is improved by the silicone resin or fluorine resin internally added to the toner. However, when the toner is used, the viscosity of the silicone resin or fluorine resin in a temperature range in a fixing nip region is high. Accordingly, the viscoelasticity of the toner in the fixing nip is increased and hence its fixability to a recording material reduces. In addition, the silicone resin or fluorine resin in the toner is poor in peelability from a fluorine resin used in the surface of a fixing member in an image forming apparatus. Accordingly, the peelability of the toner from the surface of the fixing member is reduced and hence its fixation latitude is narrowed in some cases.

In view of the foregoing, the inventors of the present invention have made extensive investigations on the problems. As a result, the inventors have found that the flowability of the toner can be improved by forming, on the surface of a toner particle, a protrusion containing an olefin-based polymer having a cyclic olefin structure.

Further, the inventors of the present invention have found that the flowability of the toner is drastically improved by optimizing the area ratio of the protrusion in the toner particle, i.e., the surface coverage of a core particle by the protrusion and the average radius of curvature of the protrusion, in short, optimum ranges exist for the surface coverage and the average radius of curvature. Details about a mechanism for the foregoing are unclear, but the following assumption has been made. The olefin-based polymer having a cyclic olefin structure to be incorporated into the protrusion has a low moisture absorbing property and hence exhibits the following effect: a liquid bridge force between the protrusions is reduced and hence a non-electrostatic adhesive force is reduced. In addition, the presence of an uneven structure in the toner particle exhibits a reducing effect on the area of contact between the toner particles. Those effects are combined to drastically reduce the aggregability of the toner, thereby improving the flowability.

Hereinafter, an embodiment of the present invention is described.

[Toner Particle]

A toner according to the present invention contains a toner particle having a core particle containing a binder resin and a colorant, and the toner particle has a protrusion on its surface. In addition, the protrusion contains an olefin-based polymer having a cyclic olefin structure.

<Core Particle>

The core particle is a particle that contains the binder resin and the colorant as materials needed for achieving a function as a toner, and contains a wax, a charge control agent, or the like as an arbitrary material.

[Binder Resin]

The binder resin to be incorporated into the core particle is not particularly limited, and for example, any one of the following polymers and resins can be used: homopolymers of styrene and substituted styrenes such as polystyrene, poly-p-chlorostyrene, and polyvinyltoluene; styrene-based copolymers such as a styrene-p-chlorostyrene copolymer, a styrene-vinyltoluene copolymer, a styrene-vinylnaphthalene copolymer, a styrene-acrylate copolymer, a styrene-methacrylate copolymer, a styrene-α-methyl chloromethacrylate copolymer, a styrene-acrylonitrile copolymer, a styrene-vinyl methyl ether copolymer, a styrene-vinyl ethyl ether copolymer, a styrene-vinyl methyl ketone copolymer, and a styrene-acrylonitrile-indene copolymer; and polyvinyl chloride, a phenol resin, a natural resin-modified phenol resin, a natural resin-modified maleic acid resin, an acrylic resin, a methacrylic resin, polyvinyl acetate, a silicone resin, a polyester resin, a polyurethane resin, a polyamide resin, a furan resin, an epoxy resin, a xylene resin, a polyvinyl butyral resin, a terpene resin, a coumarone-indene resin, and a petroleum-based resin.

[Colorant]

The colorant to be incorporated into the core particle is not particularly limited as long as a desired color image can be formed. Examples thereof include the following black, yellow, magenta, and cyan colorants.

As a black colorant, there are given: carbon black; and a colorant toned to a black color with a yellow colorant, a magenta colorant, and a cyan colorant. Although a pigment may be used alone as each of the yellow colorant, the magenta colorant, and the cyan colorant, a dye and the pigment are more preferably used in combination to improve the clarity of the colorant in terms of the quality of a full-color image.

As a magenta coloring pigment, there are given, for example: C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 146, 147, 150, 163, 184, 202, 206, 207, 209, 238, 269, or 282; C.I. Pigment Violet 19; and C.I. Vat Red 1, 2, 10, 13, 15, 23, 29, or 35.

As a magenta coloring dye, there are given, for example: oil-soluble dyes such as: C.I. Solvent Red 1, 3, 8, 23, 24, 25, 27, 30, 49, 81, 82, 83, 84, 100, 109, or 121; C.I. Disperse Red 9; C.I. Solvent Violet 8, 13, 14, 21, or 27; and C.I. Disperse Violet 1; and basic dyes such as: C.I. Basic Red 1, 2, 9, 12, 13, 14, 15, 17, 18, 22, 23, 24, 27, 29, 32, 34, 35, 36, 37, 38, 39, or 40; and C.I. Basic Violet 1, 3, 7, 10, 14, 15, 21, 25, 26, 27, or 28.

As a cyan coloring pigment, there are given, for example: C.I. Pigment Blue 2, 3, 15:2, 15:3, 15:4, 16, or 17; C.I. Vat Blue 6; C.I. Acid Blue 45; and a copper phthalocyanine pigment in which a phthalocyanine skeleton is substituted by 1 to 5 phthalimidomethyl groups.

For example, C.I. Solvent Blue 70 is given as a cyan coloring dye.

As a yellow coloring pigment, there are given, for example: C.I. Pigment Yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181, or 185; and C.I. Vat Yellow 1, 3, or 20.

As a yellow coloring dye, there are given, for example, C.I. Solvent Yellow 33, 56, 79, 82, 93, 162, and 163.

Although not particularly limited, the colorant is preferably used in an amount of 0.1 part by mass or more and 30 parts by mass or less with respect to 100 parts by mass of the binder resin.

[Release Agent]

The toner particle may contain a release agent. The release agent is not particularly limited. Examples thereof include: a hydrocarbon-based wax such as low-molecular-weight polyethylene, low-molecular-weight polypropylene, an alkylene copolymer, microcrystalline wax, paraffin wax, or Fischer-Tropsch wax; an oxide of a hydrocarbon-based wax such as oxidized polyethylene wax or a block copolymerization product thereof; a wax containing a fatty acid ester as a main component, such as carnauba wax; and a wax obtained by subjecting part or all of fatty acid esters to deacidification such as deacidified carnauba wax.

Of those release agents, a hydrocarbon-based wax such as paraffin wax or Fischer-Tropsch wax is preferred from the viewpoint of improving the low-temperature fixability of the toner and its separability from the fixing member.

Although not particularly limited, the release agent is preferably used in an amount of 0.5 part by mass or more and 20 parts by mass or less with respect to 100 parts by mass of the binder resin.

<Charge Control Agent>

A charge control agent can be incorporated into the toner particle as required. The charge control agent can be internally added to the toner particle, and can also be externally added thereto. A known charge control agent can be utilized as the charge control agent to be incorporated into the toner. The usage of the charge control agent, which is not particularly limited, is preferably 0.2 part by mass or more and 10 parts by mass or less with respect to 100 parts by mass of the binder resin.

<External Additive>

Silica, titanium oxide, aluminum oxide, or the like can be incorporated as an external additive for the toner particle from the viewpoint of improving, for example, the charging characteristic and durability characteristic of the toner.

[Protrusion]

The protrusion on the surface of the toner particle contains the olefin-based polymer having a cyclic olefin structure.

The protrusion can be formed by sticking a resin fine particle containing the olefin-based polymer having a cyclic olefin structure to the surface of the core particle according to a method to be described later.

(Resin Fine Particle)

The median diameter on a volume basis of the resin fine particle is such a size that a protrusion of a shape to be described later can be formed, e.g., 5 nm or more and 500 nm or less, preferably 10 nm or more and 400 nm or less.

An example of the olefin-based polymer having a cyclic olefin structure is a polymer obtained by a polymerization method using a metallocene-based catalyst, a Ziegler catalyst, and a catalyst for metathesis polymerization, i.e., double bond opening and ring opening polymerization reaction. The synthesis of the olefin-based polymer having a cyclic olefin structure is disclosed in, for example, Japanese Patent Application Laid-Open No. H05-339327, Japanese Patent Application Laid-Open No. H05-9223, Japanese Patent Application Laid-Open No. H06-271628, European Publication No. 203799 A, European Publication No. 407870 A, European Publication No. 283164 A, and European Publication No. 156464 A.

Specifically, the olefin-based polymer having a cyclic olefin structure can be obtained by polymerizing one or more kinds of cyclic olefin monomers, and in some cases, one kind of acyclic olefin monomer at from −78° C. to 150° C., preferably from 20° C. to 80° C. and at a pressure of from 0.001 MPa to 6.4 MPa in the presence of a catalyst formed of a cocatalyst such as an aluminoxane and at least one kind of metallocene containing, for example, zirconium or hafnium.

A preferred example of the olefin-based polymer having a cyclic olefin structure is a cyclic olefin copolymer (COC resin), which is a copolymer of a lower alkene having 2 or more and 12 or less, preferably 2 or more and 6 or less carbon atoms (α-olefin, acyclic olefin in a broad sense) and a cyclic and/or polycyclic compound having 3 or more and 17 or less, preferably 5 or more and 12 or less carbon atoms and having at least one double bond (cyclic(cyclo)olefin).

Examples of the lower alkene for forming the polymer include ethylene, propylene, and butylene. Examples of the cyclic olefin include norbornene, tetracyclododecene, dicyclopentadiene, and cyclohexene. Of those, it is particularly preferred that ethylene be selected as the lower alkene, and norbornene be selected as the cyclic olefin.

In addition, in particular, a polymer having a number-average molecular weight of from 100 to 100,000, preferably from 500 to 50,000, a weight-average molecular weight of from 200 to 300,000, preferably from 3,000 to 200,000, and a glass transition point of from −20° C. to 180° C., preferably from 40° C. to 80° C. is used as the olefin-based polymer having a cyclic olefin structure.

Examples of a commercially available COC resin include a "TOPAS" series manufactured by Polyplastics Co., Ltd., and an "APEL" series manufactured by Mitsui Chemicals, Inc.

The usage of the olefin-based polymer having a cyclic olefin structure in 100 parts by mass of a polymer constituting the resin fine particle is preferably from 50 parts by mass to 100 parts by mass. When the usage is 50 parts by mass or more, the wettability of the fine particle with water can be sufficiently reduced, and hence the protrusion can be effectively formed in a production step to be described later.

[Shapes and Distribution of Protrusions]

The toner particle according to the present invention has, on its surface, a protrusion derived from the resin fine particle. The protrusion has a substantially mountain-like (substantially hemispherical) shape as a result of the deformation of the resin fine particle upon its sticking to the surface of the core particle.

In the present invention, an average radius of curvature Rs of the protrusion, an average particle diameter Rc of the core particle, a projected area S of the toner particle, a projected area S1 of the protrusion, and an average surface coverage Cov of the protrusion in the surface of the toner particle are defined as described below.

FIG. 3A to FIG. 3E are views for illustrating methods of calculating the average radius of curvature Rs of the protrusion, the average particle diameter Rc of the core particle, the projected area S of the toner particle, the projected area S1 of the protrusion, and the average surface coverage Cov of the protrusion in the surface of the toner particle.

Figure 3A:
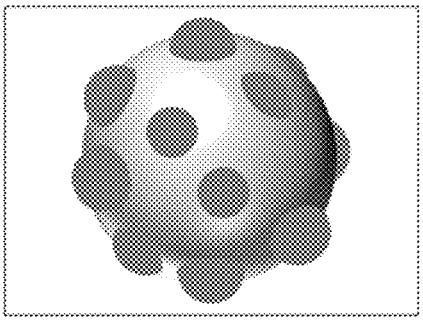
FIG. 3A, FIG. 3B, FIG. 3C, FIG. 3D, and FIG. 3E are schematic views for illustrating the uneven structure of the toner of the present invention.
Figure 3B:
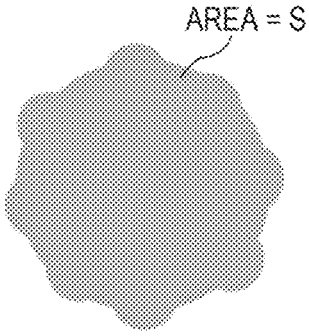

First, the toner particle of the present invention is photographed with a scanning electron microscope so that its entire image may fall within a photographing region. Next, in the planar photograph (FIG. 3A) of the toner particle that has been photographed, the planar projected image of the toner particle is sampled with image processing software such as Photoshop (FIG. 3B). Next, a circle having the largest radius, the circle occupying the largest area of the projection plane of the planar projected image of the toner particle, is sampled, and the diameter of the circle having the largest radius is defined as a particle diameter Rc1 of the core particle (FIG. 3C).

The foregoing procedure is repeatedly performed on 10 toner particles, and the average of the resultant values is defined as the average particle diameter Rc of the core particle.

Figure 3C:
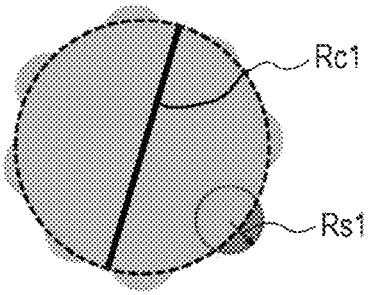
Figure 3D:
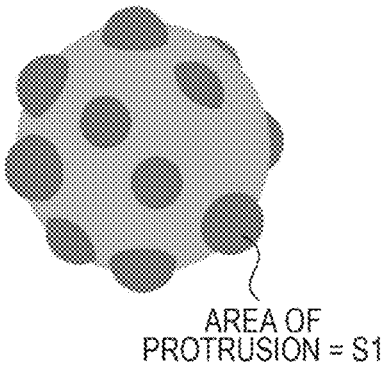
Figure 3E:
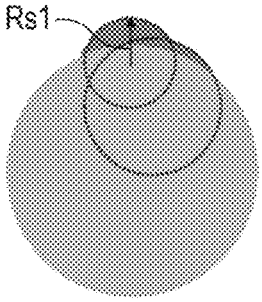

In addition, a curve forming the planar projected image of a protrusion present outside the circle having the largest radius in the planar projected image of the toner particle is fitted into an arc, and the radius of the arc is defined as a radius of curvature Rs1 of the protrusion (FIG. 3C). It should be noted that when the curve forming the planar projected image of the protrusion is fitted into a plurality of arcs, the radius of the arc into which a curve including a point most distant from the core particle is fitted is defined as the radius of curvature Rs1 of the protrusion (FIG. 3E).

The foregoing procedure is repeatedly performed on 100 protrusions, and the average of the resultant values is defined as the average radius of curvature Rs of the protrusion.

In addition, the projected area S is calculated from the planar projected image of the toner particle sampled in the foregoing procedure (FIG. 3B). Further, only protrusions on the toner particle are sampled from the planar photograph (FIG. 3A) of the toner particle (FIG. 3D), and the sum S1 of the areas of the protrusions is determined. Then, a surface coverage "100×S1/S" % of the protrusions in the surface of the toner particle is calculated.

The foregoing procedure is repeatedly performed on 10 toner particles, and the average of the resultant values is defined as the average surface coverage Cov of the protrusion in the surface of the toner particle.

"The average surface coverage Cov of the protrusion in the surface of the toner particle" means "an average of a surface coverage "100×S1/S" % defined as a ratio of the projected area S1 of the protrusion to the projected area S of the toner particle" in the present invention.

It should be noted that when it is difficult to distinguish protrusions each formed of a cyclic olefin from each other, an image in which a cyclic olefin portion has been made additionally vivid can be photographed by dyeing the protrusions with ruthenium tetroxide and observing the portions with a reflected electron image.

The average radius of curvature Rs of the protrusion is 0.004Rc μm or more and 0.100Rc μm or less, and the average surface coverage Cov of the protrusion in the surface of the toner particle is 5% or more and 90% or less.

When the average surface coverage Cov is less than 5%, the probability that non-protrusions (i.e., recesses) are brought into contact with each other between adjacent toner particles increases, and hence the flowability of the toner reduces. In addition, when the average surface coverage Cov is more than 90%, an influence of the coefficient of friction of a resin itself containing the olefin-based polymer having a cyclic olefin structure becomes larger than the reducing effect on a liquid bridge force, and hence the flowability of the toner reduces. The average surface coverage Cov is more preferably 10% or more and 85% or less.

When the average radius of curvature Rs of the protrusion is less than 0.004Rc μm, in the case where image output is performed over a long time period, the embedding of the protrusion in the core particle or the deformation of the portion is liable to occur. In addition, when the average radius of curvature Rs is more than 0.100Rc μm, the reducing effect on the area of contact between the toner particles exhibited by the presence of the uneven structure in the toner particle is impaired. The average radius of curvature Rs is more preferably 0.008Rc μm or more and 0.080Rc μm or less.

[Method of Producing Toner]

A method of producing a toner of the present invention, which is not particularly limited, is, for example, a method involving adhering a resin fine particle to the surface of a core particle, and heating the resin fine particle to deform the particle to stick the particle to the core particle. The method is more specifically, for example, a method including the following steps (1) to (4):

(1) producing a first aqueous dispersion liquid containing a resin fine particle having a median diameter on a volume basis of 5 nm or more and 500 nm or less, the resin fine particle containing an olefin-based polymer having a cyclic olefin structure;

(2) producing a second aqueous dispersion liquid containing a core particle containing a binder resin and a colorant;

(3) mixing the first aqueous dispersion liquid and the second aqueous dispersion liquid to adhere the resin fine particle to a surface of the core particle; and (4) heating the mixed dispersion liquid at a temperature equal to or more than a glass transition point of a resin constituting the resin fine particle to stick the resin fine particle to the surface of the core particle to form a protrusion.

Hereinafter, the respective steps are sequentially described.

(1) Step of producing First Aqueous Dispersion Liquid containing Resin Fine Particle having Median Diameter on Volume Basis of 5 nm or more and 500 nm or less, the Resin Fine Particle containing Olefin-based Polymer having Cyclic Olefin Structure;

An oil phase obtained by dissolving a resin containing the olefin-based polymer having a cyclic olefin structure (hereinafter sometimes referred to as "cyclic olefin-based resin") in a solvent that dissolves the resin and is insoluble in water, and an aqueous phase obtained by dissolving an anionic surfactant in ion-exchanged water are mixed, and a shear force is applied by a stirring machine to the mixture. Thus, an oil-in-water (O/W-type) emulsion having an oil phase size of several micrometers is produced. The resultant emulsion is further treated with a wet atomizing apparatus capable of applying a high shear force (such as a NANOMIZER manufactured by Yoshida Kikai Co., Ltd. or a STARBURST manufactured by Sugino Machine Limited) a plurality of times to produce an oil-in-water (O/W-type) emulsion having an oil phase size of from 5 nm to 500 nm. After that, the solvent is removed by performing distillation under reduced pressure. Thus, the first aqueous dispersion liquid having dispersed therein a fine particle of the cyclic olefin-based resin having a median diameter on a volume basis of 5 nm or more and 500 nm or less can be obtained. The median diameter on a volume basis of the fine particle is more preferably 10 nm or more and 400 nm or less.

(2) Step of producing Second Aqueous Dispersion Liquid containing Core Particle;

An aqueous dispersion liquid containing a core particle is produced by dispersing the core particle with an anionic surfactant or the like. As described in the foregoing, the core particle is a particle containing a binder resin, a colorant, a release agent, a charge control agent, or the like, and a particle produced by an emulsion aggregation method, a suspension polymerization method, or the like can be used.

With regard to the average particle diameter Rc μm of the core particle, for example, a core particle having an average particle diameter of from 3 μm to 15 μm produced by the emulsion aggregation method is preferably used, and a core particle having an average particle diameter of from 4 μm to 12 μm is more preferably used.

(3) Step of mixing First Aqueous Dispersion Liquid and Second Aqueous Dispersion Liquid to adhere Resin Fine Particle to Surface of Core Particle;

The first aqueous dispersion liquid produced in the step (1) and the second aqueous dispersion liquid produced in the step (2) are mixed at a proper ratio, and dilute hydrochloric acid as an aggregating agent is gradually added to the mixed dispersion liquid while the liquid is stirred. Thus, a mixed dispersion liquid containing the core particle to which the resin fine particles have adhered in a substantially uniform manner can be obtained. That is, the resin fine particle can be adhered to the surface of the core particle by an acid aggregation method. The concentration of the dilute hydrochloric acid is, for example, from 0.01 mol/l to 8 mol/l, and its addition rate is, for example, from 1 ml/min to 50 ml/min.

(4) Step of heating the Mixed Dispersion Liquid at Temperature equal to or more than Glass Transition Point of Resin constituting the Resin Fine Particle to stick the Resin Fine Particle to Surface of the Core Particle to form protrusion;

The mixed dispersion liquid is heated at the temperature equal to or more than the glass transition point of the resin constituting the resin fine particle for some time while being stirred. The cyclic olefin-based resin incompatible with a resin forming the surface of the core particle is not compatible with the core particle on the surface of the core particle, but the fine particles each containing the cyclic olefin-based resin aggregate to be compatible with each other. Accordingly, the protrusion derived from the cyclic olefin-based resin is formed on the surface of the core particle.

The average radius of curvature and surface coverage of the protrusion can be set to desired values by appropriately adjusting the amount of the cyclic olefin-based resin to be mixed with the core particle, the heating temperature, and the heating time. The optimum range of the heating temperature varies depending on whether or not the core particle contains the release agent. In the case where the core particle contains the release agent, the heating is preferably performed at a temperature that is equal to or more than the glass transition point of the cyclic olefin-based resin constituting the protrusion and is equal to or less than the melting point of the release agent because of the following reason: as the heating temperature reaches a temperature equal to or more than the melting point of the release agent, the release agent may appear on the surface of the core particle to adversely affect the chargeability, storage stability, and the like of the toner. The foregoing does not apply to the case where the core particle does not contain the release agent, and the heating is preferably performed at a temperature that is equal to or more than the glass transition point of the cyclic olefin-based resin constituting the protrusion and is equal to or less than the thermal decomposition temperature of each material constituting the toner.

The heating time cannot be indiscriminately specified because of the following reason: when the heating temperature is high, a short time period suffices, and when the heating temperature is low, a long time period is needed. In general, however, a heating time of from 5 minutes to 120 minutes is preferred. It should be noted that the glass transition point of the cyclic olefin-based resin is, for example, 60° C., and the glass transition point of the release agent in the core particle is, for example, 78° C.

After the heating step for obtaining a desired protrusion structure has been completed, the aqueous dispersion liquid of a toner particle having the protrusion is preferably cooled to a temperature equal to or less than the glass transition point of the cyclic olefin-based resin in order that the aggregation and fusion of the protrusions may be prevented from progressing further.

After that, water washing and filtration are repeatedly performed for removing the surfactant, and the remainder is dried with a drying machine or the like. Thus, the toner particle having the protrusion of the cyclic olefin-based resin on the surface of the core particle can be obtained. The drying is performed under the conditions of, for example, a temperature of from 20° C. to 50° C. and a time of from 3 hours to 72 hours.

According to one aspect of the present invention, an electrophotographic toner excellent in charging stability and having high flowability can be obtained. The use of such toner in the formation of an electrophotographic image enables the provision of an image, which stably has high quality independent of an environment, over a long time period.

In addition, according to another aspect of the present invention, a toner that has charging stability independent of an environment and has high flowability can be produced, and hence a toner that can provide stable image quality independent of an environment over a long time period can be obtained.

Hereinafter, the present invention is described more specifically by way of Preparation Examples, Examples, and Comparative Examples.

Preparation Example 1

Production of Aqueous Dispersion Liquid E1 of Resin Fine Particle

Materials whose kinds and amounts were shown in Table 1 below were prepared. First, an oil phase was produced by mixing a COC resin and chloroform to dissolve the COC resin in chloroform. In addition, an anionic surfactant and ion-exchanged water were mixed to produce an aqueous phase.

TABLE 1

| Material | Parts by mass |
|---|---|
| COC resin (manufactured by Polyplastics Co., Ltd., TOPAS (trademark) grade TM) | 100 |
| Chloroform | 300 |
| Anionic surfactant (manufactured by NOF Corporation, NONSOUL LN1) | 8 |
| Ion-exchanged water | 925 |

Next, the oil phase and the aqueous phase were mixed, and the mixture was stirred with a ROBOMIX manufactured by PRIMIX Corporation under the condition of from 8,000 rpm to 9,000 rpm for 30 minutes to produce an oil-in-water (O/W-type) emulsion having an oil droplet size of 1 μm. Further, the emulsion was treated with a NANOMIZER manufactured by Yoshida Kikai Co., Ltd. (under the condition of 20 MPa) three times to produce an oil-in-water (O/W-type) emulsion having an oil droplet size of 100 nm. Chloroform was removed by distilling the emulsion under reduced pressure, and then the solid content concentration of the remainder was adjusted to 10 mass %. Thus, an aqueous dispersion liquid E1 having dispersed therein a fine particle of the COC resin having a median diameter on a volume basis of 80 nm was produced. It should be noted that the particle diameter of the fine particle of the COC resin was measured with a dynamic light scattering particle size distribution measuring device (NANOTRAC: manufactured by Nikkiso Co., Ltd.).

Preparation Example 2

Production of Aqueous Dispersion Liquid E2 of Resin Fine Particle

An aqueous dispersion liquid E2 having dispersed therein a fine particle of the COC resin having a median diameter on a volume basis of 10 nm (solid content concentration: 10 mass %) was produced in the same manner as in Preparation Example 1 except that in Preparation Example 1, the amount of the COC resin was changed to 40 parts by mass and the amount of chloroform was changed to 360 parts by mass.

Preparation Example 3

Production of Aqueous Dispersion Liquid E3 of Resin Fine Particle

An aqueous dispersion liquid E3 having dispersed therein a fine particle of the COC resin having a median diameter on a volume basis of 150 nm (solid content concentration: 10 mass %) was produced in the same manner as in Preparation Example 1 except that in Preparation Example 1, the pressure condition at the time of the treatment with the NANOMIZER was changed to 10 MPa.

Preparation Example 4

Production of Aqueous Dispersion Liquid E4 of Resin Fine Particle

An aqueous dispersion liquid E4 having dispersed therein a fine particle of the COC resin having a median diameter on a volume basis of 180 nm (solid content concentration: 10 mass %) was produced in the same manner as in Preparation Example 1 except that in Preparation Example 1, the COC resin was changed to 70 parts by mass of the grade TM and 30 parts by mass of a grade TB and the amount of chloroform was changed to 500 parts by mass.

Preparation Example 5

Production of Dispersion Liquid A1 of Resin Fine Particle for Core Particle

Materials whose kinds and amounts were shown in Table below were mixed, and 177.80 parts by mass of ion-exchanged water was dropped to the mixed liquid while the mixed liquid was stirred with an ultra-high speed stirring apparatus T.K. ROBOMIX (manufactured by PRIMIX Corporation) at 4,000 rpm. After that, tetrahydrofuran was removed by using an evaporator. Thus, a dispersion liquid A1 of a resin fine particle for a core particle was obtained. The median diameter on a volume basis of the resin fine particle for a core particle in the dispersion liquid A1 was measured with a dynamic light scattering particle size distribution measuring device (NANOTRAC: manufactured by Nikkiso Co., Ltd.). As a result, the median diameter was 90 nm.

TABLE 2

| Material | Part(s) by mass |
|---|---|
| Polyester resin A (molar composition ratio: polyoxypropylene (2.2)-(2,2)-bis(4-hydroxyphenyl)propane/polyoxyethylene(2.0)-2,2-bis(4-hydroxypheyl)propane/terephthalic acid/fumaric acid/trimellitic acid = 25/25/26/20/4, Mn = 3,500, Mw = 10,300, Mw/Mn = 2.9, Tm = 96° C., Tg = 56° C., acid value = 12 mg KOH/g) | 60 |
| Anionic surfactant (manufactured by DKS Co. Ltd.: NEOGEN RK) | 0.3 |
| N,N-Dimethylaminoethanol | 1.9 |
| Tetrahydrofuran (manufactured by Wako Pure Chemical Industries, Ltd.) | 200 |

Preparation Example 6

Production of Aqueous Dispersion Liquid A2 of Colorant Fine Particle

Materials whose kinds and amounts were shown in Table 3 below were mixed, and the mixture was dispersed with a high-pressure impact-type dispersing machine NANOMIZER (manufactured by Yoshida Kikai Co., Ltd.) for 1 hour. Thus, an aqueous dispersion liquid of a colorant fine particle obtained by dispersing a colorant was prepared. The median diameter on a volume basis of the colorant fine particle in the dispersion liquid A2 was measured with a dynamic light scattering particle size distribution measuring device (NANOTRAC: manufactured by Nikkiso Co., Ltd.). As a result, the median diameter was 200 nm.

TABLE 3

| Material | Parts by mass |
|---|---|
| Cyan pigment (manufactured by Dainichiseika Color & Chemicals Mfg. Co., Ltd.: Pigment Blue 15:3) | 100 |
| Anionic surfactant (manufactured by DKS Co. Ltd.: NEOGEN RK) | 15 |
| Ion-exchanged water | 885 |

Preparation Example 7

Production of Aqueous Dispersion Liquid A3 of Release Agent Fine Particle

Materials whose kinds and amounts were shown in Table 4 below were loaded into a mixing vessel with a stirring apparatus, and then the mixture was heated to 90° C. While the mixture was circulated into a CLEARMIX W-MOTION (manufactured by M Technique Co., Ltd.), the mixture was subjected to a dispersion treatment for 60 minutes by being stirred in a shear stirring site having a rotor outer diameter of 3 cm and a clearance of 0.3 mm under the conditions of a number of rotor revolutions of 19,000 rpm and a number of screen revolutions of 19,000 rpm. After that, the resultant was cooled to 40° C. under the cooling treatment conditions of a number of rotor revolutions of 1,000 rpm, a number of screen revolutions of 0 rpm, and a cooling rate of 10° C./min to provide an aqueous dispersion liquid A3 of a release agent fine particle. The median diameter on a volume basis of the release agent fine particle in the dispersion liquid A3 was 150 nm.

TABLE 4

| Material | Parts by mass |
|---|---|
| Ester wax (behenyl behenate, melting point: 75° C.) | 100 |
| Anionic surfactant (manufactured by DKS Co. Ltd.: NEOGEN RK) | 10 |
| Ion-exchanged water | 890 |

Preparation Example 8

Production of Aqueous Dispersion Liquid A4 of Charge Control Agent Fine Particle Materials whose kinds and amounts were shown in Table 5 below were loaded into a reactor mounted with a cooling tube, a stirring machine, a temperature gauge, and a nitrogen introducing tube, and nitrogen bubbling was performed for 30 minutes. The reaction mixture was heated under a nitrogen atmosphere at 120° C. for 6 hours. Thus, a polymerization reaction was completed. The reaction liquid was cooled to room temperature and then the solvent was distilled off under reduced pressure. The resultant solid was reprecipitated with the mixture of acetone and methanol twice, and was dried at 50° C. under a reduced pressure of 0.1 kPa or less to provide a charge control agent fine particle.

TABLE 5

| Material | Parts by mass |
|---|---|
| Styrene | 100 |
| 2-Acrylamido-2-methylpropanesulfonic acid | 6.7 |
| tert-Butyl peroxy isopropyl carbonate (PERBUTYL I-75, manufactured by NOF Corporation) | 7.2 |
| Propylene glycol monomethyl ether acetate | 200 |

It was confirmed from H NMR analysis and neutralization titration that the resultant charge control agent fine particle contained 3 mol % of a 2-acrylamide-2-methylpropanesulfonic acid unit in all monomer units. In addition, the fine particle had a weight-average molecular weight (Mw) measured by size exclusion chromatography (SEC) analysis of 13,500.

5 Parts by mass of the charge control agent fine particle obtained in the foregoing was dissolved in 8 parts by mass of tetrahydrofuran (THF), and 0.4 part by mass of N,N-dimethyl-2-aminoethanol was added to the solution. After that, 28 parts by mass of ion-exchanged water was slowly dropped to the mixture while the mixture was vigorously stirred at room temperature. THF was distilled off from the resultant dispersion liquid under reduced pressure at 50° C., and then the solid content concentration of the remainder was adjusted to 20 mass %. Thus, an aqueous dispersion liquid A4 of the charge control agent fine particle was obtained. The median diameter on a volume basis of the charge control agent fine particle in the dispersion liquid was measured with a dynamic light scattering particle size distribution measuring device (NANOTRAC: manufactured by Nikkiso Co., Ltd.). As a result, the median diameter was 30 nm.

Preparation Example 9

Production of Core Particle (a)

Materials whose kinds and amounts were shown in Table 6 below were dispersed with a homogenizer (manufactured by IKA: ULTRA-TURRAX T50), and then the dispersed product was heated to 45° C. in a heating water bath while being stirred with a stirring blade. After the temperature of the resultant had been held at 45° C. for 1 hour, the resultant was observed with an optical microscope. As a result, it was confirmed that an aggregated particle having an average particle diameter of 5 μm was formed. 40 Parts by mass of a 5 mass % aqueous solution of trisodium citrate was added to the resultant, and then the temperature of the mixture was increased to 85° C. while the stirring was continued. The temperature was held at the value for 120 minutes so that core particles were fused. Next, while the stirring was continued, water was loaded into the water bath to cool the temperature of the resultant to 25° C., and the surfactant was washed off by repeating water washing and filtration. After that, the remainder was dried in a drying machine set to 30° C. for 48 hours. Thus, a core particle (a) containing a polyester resin, a pigment, a release agent, and a charge control agent was obtained. It should be noted that the contents of the respective components in the core particle (a) were as follows: the particle contained 100 parts by mass of the PEs resin, 5 parts by mass of the pigment, 10 parts by mass of the release agent, and 0.2 part by mass of the charge control agent.

TABLE 6

| Material | Parts by mass |
|---|---|
| Dispersion liquid A1 of resin fine particle for core particle | 40 |
| Aqueous dispersion liquid A2 of colorant fine particle | 10 |
| Aqueous dispersion liquid A3 of release agent fine particle | 20 |
| Aqueous dispersion liquid A4 of charge control agent fine particle | 2 |
| 1 mass % aqueous solution of magnesium sulfate | 20 |
| Ion-exchanged water | 140 |

Example 1

1. Production of Aqueous Dispersion Liquid of Core Particle

Materials whose kinds and amounts were shown in Table below were used. The core particle (a) obtained in Preparation Example 9, a 0.1 mass % aqueous solution of an anionic surfactant (b), a 0.2 mass % aqueous solution of an anionic surfactant (c), and ion-exchanged water (d) were mixed to prepare an "first aqueous dispersion liquid" of the core particle. In addition, the aqueous dispersion liquid E1 of the fine particle of the COC resin (e) obtained in Preparation Example 1 and a 0.1 mass % aqueous solution of an anionic surfactant (f) were mixed to prepare an "second aqueous dispersion liquid" of the fine particle.

TABLE 7

| Component | Material | Part (s) by mass |
|---|---|---|
| (a) | Core particle (a) using PEs as binder resin (Rc: 5 μm) | 10 |
| (b) | 0.1 mass % aqueous solution of anionic surfactant (manufactured by DKS Co. Ltd., NEOGEN RK) | 48 |
| (c) | 0.2 mass % aqueous solution of anionic surfactant (manufactured by NOF Corporation, NONSOUL LN1) | 0.5 |
| (d) | Ion-exchanged water | 133 |
| (e) | Aqueous dispersion liquid E1 of fine particle of COC resin | 1 |
| (f) | 0.1 mass % aqueous solution of anionic surfactant (manufactured by DKS Co. Ltd., NEOGEN RK) | 115.2 |

2. Adhesion of Resin Fine Particle to Surface of Core Particle

The first aqueous dispersion liquid (191.5 g) and the second aqueous dispersion liquid (12.52 g) were mixed in a 1,000-ml container, and the temperature of a heating water bath was increased to 43° C. while the mixed liquid was stirred. While the stirring was continued at the temperature, hydrochloric acid having a concentration of 2 mol/l was dropped to the mixed liquid at a rate of 14 ml/min. A small amount of the mixed liquid was extracted whenever necessary, and the hydrochloric acid was loaded until a filtrate obtained by passing the mixed liquid through a micro filter having an aperture of 2 μm became transparent (in other words, until a fine particle of the COC resin present in a dispersed state in the mixed liquid substantially disappeared, and substantially all fine particles of the COC resin adhered to the core particle). Thus, the fine particles of the COC resin were adhered to the surface of the core particle in a substantially uniform manner.

3. Formation of Protrusion by Heating

Next, while the stirring was continued, the temperature of the heating water bath was increased to 65° C., and the fine particle of the COC resin was softened and deformed by heating the aqueous dispersion liquid for 30 minutes, whereby the fine particle was stuck to the core particle. After that, the temperature of the aqueous dispersion liquid was reduced to 15° C. by cooling the liquid with water. Thus, an aqueous dispersion liquid of a toner particle in which a protrusion of the COC resin was formed on the surface of the core particle was produced.

4. Production of Toner by Drying

Next, the surfactants were washed off by repeating water washing and filtration, and then the remainder was dried in a drying machine. Thus, a toner particle 1 having the protrusion of the COC resin on the surface of the core particle was obtained. The toner particle had a surface coverage (i.e. an average surface coverage Cov of the protrusion in the surface of the toner particle) of 5% and an average radius of curvature of 150 nm.

Examples 2 to 7

Toner particles 2 to 7 were each obtained in the same manner as in Example 1 except that the kind and usage of the aqueous dispersion liquid (E1, E2, E3 or E4) of the fine particle, and the heating temperature in the step of forming the protrusion were changed to conditions shown in Table 8. The surface coverages and average radii of curvature of the respective toner particles are shown in Table 8.

Example 8

A toner particle 8 was obtained in the same manner as in Example 1 except that the PEs as the binder resin in Example 1 was changed to the mixed resin of the PEs and the COC. The surface coverage and average radius of curvature of the toner particle are shown in Table 8.

Comparative Examples 1 to 4

Toner particles C1 to C4 were each obtained in the same manner as in Example 1 except that the kind and usage of the aqueous dispersion liquid of the fine particle, and the heating temperature in the step of forming the protrusion were changed to conditions shown in Table 8. The surface coverages and average radii of curvature of the respective toner particles are shown in Table 8.

Comparative Example 5

A toner particle C5 was obtained in the same manner as in Example 1 except that: the COC was used as a binder resin; the aqueous dispersion liquid of the fine particle was not used; and the step of adhering the fine particle to the surface of the core particle and the step of forming the protrusion by heating were not performed. The surface coverage and average radius of curvature of the toner particle are shown in Table 8.

TABLE 8

| | Core particle | Fine particle | | | | Step of forming protrusion | | Toner particle | | | Flowability | | | |
|---|---|---|---|---|---|---|---|---|---|---|---|---|---|---|
| | Binder resin | Resin | Median diameter on a volume basis (nm) | (e) Aqueous dispersion liquid Kind | Usage (part(s) by mass) | Heating temperature (° C.) | Heating time min) | Surface coverage (%) | Average particle diameter Rc of core particle (μm) | Average radius of curvature of protrusion (nm) | Initial | After endurance running | Fogging | Fixation latitude |
| Comparative Example 1 | PEs | COC | 80 | E1 | 0.4 | 65 | 30 | 2 | 5.0 | 150 | C | C | A | A |
| Example 1 | PEs | COC | 80 | E1 | 1 | 65 | 30 | 5 | 5.0 | 150 | A | A | A | A |
| Example 2 | PEs | COC | 80 | E1 | 10 | 65 | 30 | 50 | 5.1 | 150 | A | A | A | A |

TABLE 8-continued

| | Core particle Binder resin | Fine particle Resin | Median diameter on a volume basis (nm) | (e) Aqueous dispersion liquid Kind | Usage (part(s) by mass) | Step of forming protrusion Heating temperature (° C.) | Heating time min) | Toner particle Surface coverage (%) | Average particle diameter Rc of core particle (μm) | Average radius of curvature of protrusion (nm) | Flowability Initial | After endurance running | Fogging | Fixation latitude |
|---|---|---|---|---|---|---|---|---|---|---|---|---|---|---|
| Example 3 | PEs | COC | 80 | E1 | 18 | 65 | 30 | 90 | 5.0 | 150 | A | A | A | A |
| Comparative Example 2 | PEs | COC | 80 | E1 | 19 | 65 | 30 | 95 | 5.1 | 150 | C | C | A | A |
| Comparative Example 3 | PEs | COC | 10 | E2 | 0.75 | 65 | 5 | 45 | 5.0 | 15 | A | C | A | A |
| Example 4 | PEs | COC | 10 | E2 | 0.75 | 65 | 10 | 45 | 5.0 | 20 | A | B | A | A |
| Example 5 | PEs | COC | 80 | E1 | 10 | 65 | 35 | 45 | 5.0 | 200 | A | A | A | A |
| Example 6 | PEs | COC | 150 | E3 | 25 | 65 | 30 | 45 | 5.1 | 500 | A | A | A | A |
| Example 7 | PEs | COC | 180 | E4 | 20 | 65 | 20 | 35 | 5.1 | 400 | A | A | A | S |
| Comparative Example 4 | PEs | COC | 150 | E3 | 30 | 65 | 40 | 45 | 5.0 | 600 | C | C | A | A |
| Example 8 | PEs and COC | COC | 80 | E1 | 10 | 65 | 30 | 50 | 5.1 | 150 | A | A | S | A |
| Comparative Example 5 | COC | None | — | — | — | — | — | — | 5.1 | — | C | C | A | A |

[Evaluation of Toner]

An external addition treatment was performed by: adding 1.8 parts by mass of silica fine powder subjected to a hydrophobic treatment, the powder having a specific surface area measured by a BET method of 200 $m^2/g$, to 100 parts by mass of each of the toner particles 1 to 8 and toner particles C1 to C5 obtained in Examples and Comparative Examples described above; and subjecting the contents to dry mixing with a Henschel mixer (manufactured by Mitsui Mining Co., Ltd.). Thus, toners 1 to 8 and toners C1 to C5 were obtained. The following evaluations were performed on each of those toners. The results of the evaluations are shown in Table 8.

(1. Evaluation for Fogging)

An evaluation for a fogging amount is performed after an image forming apparatus has been left to stand in an evaluation environment (having a temperature of 30° C. and a relative humidity of 80%) for 1 day in advance to be adapted to the environment. A specific evaluation method is as described below. The image forming apparatus is stopped during the printing of a solid white image, a toner on its photosensitive member after development and before transfer is transferred onto a transparent tape once, and the tape to which the toner has adhered is attached to recording paper. In addition, a tape to which no toner has adhered is attached onto the same recording paper. Optical reflectances are measured from above the tapes attached to the recording paper with an optical reflectance measuring machine (trade name: TC-6DS; manufactured by Tokyo Denshoku Co., Ltd.). A value "r0-r1" obtained by subtracting an optical reflectance r1 of the tape to which the toner has adhered from an optical reflectance r0 of the tape to which no toner has adhered is defined as the fogging amount. The fogging amount is measured at three points of each tape, and the average of the three measured values is determined.

S: The fogging amount is less than 1.0%.

A: The fogging amount is from 1.0% to less than 3.0%.

B: The fogging amount is from 3.0% to less than 5.0%.

C: The fogging amount is 5.0% or more.

(2. Evaluation for Fixation Latitude)

An image forming apparatus is adjusted in advance so that the amount of a toner on recording paper before fixation at the time of the printing of a solid image may be 0.6 $mg/cm^2$. After the adjustment, the fixation temperature of its fixing unit is set to from 100° C. to 200° C. in increments of 10° C. The solid image is printed at the respective temperatures (a total of 11 points), and an offset image test and a rubbing fixability test are performed on each of the resultant images.

Upon determination of the fixation temperature, attention should be paid to the following fact: a hot offset critical temperature exists at higher temperatures, and a hot offset phenomenon occurs as the fixation temperature exceeds the temperature; meanwhile, a fixability critical temperature exists at lower temperatures, and a fixation failure occurs as the fixation temperature falls short of the temperature. Here, the term "hot offset phenomenon" refers to a phenomenon in which the toner melted in a fixing nip is separated between the recording paper and a fixing sleeve to transfer to the surface of the fixing sleeve. In the case where the hot offset phenomenon occurs, when the fixing sleeve rotates once and hence the toner that has transferred to the surface of the fixing sleeve is brought into contact with the recording paper again, the toner that has transferred to the surface of the fixing sleeve transfers onto the recording paper again to be fixed. An image to be formed at this time is referred to as "offset image".

In the offset image test in this evaluation, an optical reflectance r11 of the offset image is measured with an optical reflectance measuring machine (trade name: TC-6DS; manufactured by Tokyo Denshoku Co., Ltd.), and a value "r10-r11" obtained by subtracting the r11 from an optical reflectance r10 of a non-printing portion on evaluation paper is determined. When the value is less than 0.5%, the toner is judged as having passed the test.

In the rubbing fixability test in this evaluation, under a load of 200 g, an image obtained after passage through the fixing unit is rubbed with lens-cleaning paper (cleaning paper) in a reciprocating manner at an amplitude of 100 mm five times, followed by the calculation of the percentage (%)

by which a reflection density reduces owing to the peeling of the image. An evaluation for the reflection density of a fixed image is performed by measuring the reflection density with an X-Rite (manufactured by X-Rite). In the rubbing fixability test, when the percentage by which the reflection density of the image reduces is 10% or less, the toner is judged as having passed the test.

Only when the toner is judged as having passed both the offset image test and rubbing fixability test in this evaluation, the toner is regarded as showing "good fixability". As the number of temperatures at which the toner shows good fixability increases, the toner can be said to have a wider fixation latitude.

S: The toner shows good fixability at 8 or more fixation temperatures out of the 11 fixation temperatures.

A: The toner shows good fixability at from 6 to 7 fixation temperatures out of the 11 fixation temperatures.

B: The toner shows good fixability at from 4 to 5 fixation temperatures out of the 11 fixation temperatures.

C: The toner shows good fixability at 3 or less fixation temperatures out of the 11 fixation temperatures.

(3. Evaluation for Flowability)

An evaluation for the flowability of a toner is performed by using a transport property index described below.

The transport property index is obtained by indexing the mobility of the toner in a state in which constant vibration is applied thereto, the mobility being measured with a transport property measuring apparatus (manufactured by Konica Minolta, Inc.) illustrated in FIG. 1. In addition, the index represents the ease with which the toner is transported, i.e., the ease with which the toner is conveyed.

The transport property index is an indicator different from flowability evaluated by, for example, an angle of repose at the time of the generally called "rest" of the toner. The extent to which the toner is conveyed can be indexed in an additionally significant manner because the transport property index is calculated from the step of actually conveying the toner.

Figure 2A:
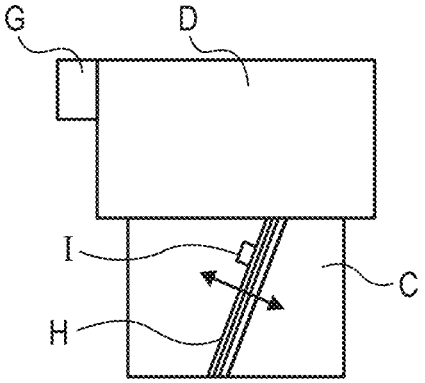
FIG. 2A and FIG. 2B are views for illustrating the transport property measuring apparatus to be used in the evaluation of the toner of the present invention.
Figure 2B:
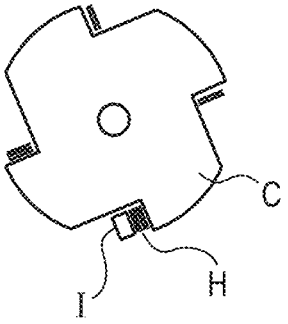

Specifically, the transport property measuring apparatus is formed of a part feeder A and a measuring unit B for measuring the mass of the conveyed toner as illustrated in FIG. 1. As illustrated in FIG. 1, FIG. 2A, and FIG. 2B, the part feeder A includes a driving source C (manufactured by Shinko Electric Co., Ltd.: ME-14C) for producing specific vibration and a cylindrical bowl D supported above the driving source C. A helical ramp E for causing the bottom surface and upper edge of the bowl D to communicate with each other is formed along the inner peripheral wall surface thereof.

Here, the ramp E is arranged in such a manner that its upper end portion Ea protrudes toward the outside in a radial direction from the side wall of the bowl D at the same height position as that of the upper edge of the bowl D. The ramp E of the bowl D has a width of 8 mm and the surface roughness of the ramp portion E is 4 μm in terms of a ten-point average roughness Ra. The tilt angle of the direction in which the toner is moved by the vibration relative to a horizontal plane is 1.7°, and the mass of the bowl D is 1,293 g.

In FIG. 1, FIG. 2A and FIG. 2B, the bowl D has a central axis F, a saucer G is arranged below the upper end portion Ea of the ramp E, and the measuring unit B is connected to the saucer G. In the part feeder, rotatory power supplied from the driving source C is transmitted to the bowl D to be transformed into a vibrational motion for entirely vibrating the bowl D, and the return position of a vertical motion is changed by an action of a flat spring H arranged with an angle. Accordingly, the toner positioned in the bowl D is transported upward along the ramp E and falls from the upper end portion Ea of the ramp E to the saucer G. It should be noted that the amplitude in a direction vertical to the flat spring H can be measured by placing a sensor I (DIGITAL VIBRATION METER 1332A-00F manufactured by Showa Sokki Corporation) of a digital display-type vibrator on the flat spring H.

The measurement of the transport property index of the toner in the present invention is as described below. First, 1.0 g of the toner is loaded around the central axis F inside the bowl D, and the driving source C is driven under the conditions of a frequency of 125 Hz and an amplitude in the direction vertical to the flat spring H of 0.33 mm to transport the toner upward along the ramp E so that the toner may reach the saucer G. Next, time points $T_{300}$ and $T_{700}$ at which the amount of the toner measured by the measuring unit B reaches 300 mg and 700 mg, respectively from the time point at which the driving of the driving source C is initiated are measured, and the index is calculated from the following general equation.

$$\text{Transport property index} = \frac{(700 - 300)\ \text{mg}}{(T_{700} - T_{300})\ \text{sec}}$$

When the transport property index is less than 0.2 mg/sec, the transport property of the toner itself is so low that the toner cannot be sufficiently supplied by a toner supplying member. When the transport property index starts to exceed 9.0 mg/sec, the supply of the toner becomes nonuniform and hence image unevenness is liable to occur.

S: The transport property index is 0.2 mg/sec or more and less than 6.0 mg/sec.

A: The transport property index is 6.0 mg/sec or more and less than 9.0 mg/sec.

B: The transport property index is 9.0 mg/sec or more and less than 15.0 mg/sec.

C: The transport property index is 15.0 mg/sec or more.

D: The transport property index is less than 0.2 mg/sec.

In addition, the measurement of the transport property index is performed on each of the toner at the initial stage of image formation and the toner after endurance running (after printing on 3,000 sheets).

With regard to the toner at the initial stage of the image formation, the transport property index is measured after the produced toner and the transport property measuring apparatus have been left to stand in an evaluation environment (having a temperature of 30° C. and a relative humidity of 80%) for 1 day in advance to be adapted to the evaluation environment.

In addition, with regard to the toner after the endurance running, after an image forming apparatus has been left to stand in the evaluation environment for 1 day, first, a horizontal line image having an image ratio of 5% is printed on 3,000 sheets of paper. The toner is removed from the inside of the image forming apparatus that has completed the printing on the 3,000 sheets, and its transport property index is measured with the transport property measuring apparatus adapted to the evaluation environment in advance.

<Discussion of Results of Evaluations>

In each of Examples 1 to 3 each satisfying the requirement that the surface coverage be 5% or more and 90% or less specified in claim 1, the aggregability of the toner can be reduced, and hence the toner can maintain high flowability throughout a time period from the initial stage to a time point after the endurance running.

In addition, the resin forming the protrusion is the cyclic olefin-based resin, and hence the moisture absorbing property of the surface of the toner particle can be reduced, and the toner showing small fogging and having high charging stability independent of an environment is obtained. In addition, the viscosity of the cyclic olefin-based resin forming the protrusion can be sufficiently reduced in a fixing nip in a fixing system, and hence the fixation latitude of the toner can be kept wide.

On the other hand, in Comparative Example 1, the surface coverage is less than 5% and hence the probability that core particles are brought into contact with each other between adjacent toner particles increases, and the toner cannot secure high flowability.

In addition, in Comparative Example 2, probably because the surface coverage is more than 90%, an influence of the coefficient of friction of the cyclic olefin-based resin itself becomes larger than a reducing effect on a liquid bridge force exhibited by the resin, and hence the toner cannot secure high flowability.

In each of Examples 4 to 7, while the particle diameter of the core particle is 5 μm, the average radius of curvature of the protrusion is 20 nm or more and 500 nm or less, and hence the average particle diameter Rc of the core particle and the average radius of curvature Rs of the protrusion satisfy the relationship specified in claim 1. In each of Examples 4 to 7, the aggregability of the toner can be reduced, and hence the toner can maintain high flowability throughout a time period from the initial stage to a time point after the endurance running. In addition, the resin forming the protrusion is the cyclic olefin-based resin, and hence the moisture absorbing property of the surface of the toner particle can be reduced, and the toner showing small fogging and having high charging stability independent of an environment is obtained. In addition, the viscosity of the cyclic olefin-based resin forming the protrusion can be sufficiently reduced in the fixing nip in the fixing system, and hence the fixation latitude of the toner can be kept wide.

In addition, in Example 8, the cyclic olefin-based resin forming the protrusion is changed, and the grade TB whose weight-average molecular weight peaks are present at two points, i.e., 8,000 and 800,000 is mixed in addition to the grade TM whose molecular weight distribution has a peak at a weight-average molecular weight of 8,000. Probably as a result of the foregoing, the hot offset resistance of the toner can be improved and its fixation latitude can be widened to some extent.

On the other hand, in Comparative Example 3, the average radius of curvature of the protrusion is 15 nm, which is less than 0.004Rc μm. Accordingly, the embedding of the protrusion in the core particle or the deformation of the protrusion occurs after the endurance running in which image output has been performed over a long time period, and hence the flowability of the toner cannot be maintained.

In addition, in Comparative Example 4, the average radius of curvature of the protrusion is 600 nm, which is more than 0.100Rc μm. Accordingly, a reducing effect on the area of contact between core particles in adjacent toner particles is small, with the result that the flowability of the toner at the initial stage and that after the endurance running are low.

In addition, the toner of Example 8 is of a construction different from that of the toner of Example 2 in that the binder resin of the core particle contains the olefin-based polymer. As a result, as compared with the toner of Example 2, the moisture absorbing property of the core portion of the toner is additionally reduced and an image showing additionally reduced fogging is obtained.

Comparative Example 5 is an example in which a toner particle free of any uneven structure on its surface and using the cyclic olefin-based resin as its binder resin is produced. An influence of the large coefficient of friction of the resin itself appears to provide the following result: the flowability of the toner at the initial stage and that after the endurance running are low.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-130690, filed Jun. 25, 2014, which is hereby incorporated by reference herein in its entirety.

What is claimed is:

1. A toner, comprising a toner particle comprising a core particle containing a binder resin and a colorant;

the toner particle having a protrusion on a surface thereof, the protrusion containing an olefin-based polymer having a cyclic olefin structure containing a copolymer obtained from an acyclic $C_{2-12}$ olefin and a cyclic $C_{3-17}$ olefin, wherein an average radius of curvature of the protrusion Rs (μm) is 0.004Rc to 0.100Rc μm and an average of a surface coverage 100×S1/S is 5 to 90%, when an average particle diameter of the core particle is defined as Rc (μm), a projected area of the toner particle is defined as S, and a projected area of the protrusion is defined as S1, Rs (μm), Rc (μm), S and S1 being calculated from a planar projected image of an image of the toner particle photographed with a scanning electron microscope.

2. A toner according to claim 1, wherein the binder resin contains at least one kind of olefin-based polymer.

3. A method of producing the toner of claim 1, comprising:

(1) producing a first aqueous dispersion liquid containing a resin fine particle having a median diameter on a volume basis of 5 nm or more and 500 nm or less, the resin fine particle containing an olefin-based polymer having a cyclic olefin structure;

(2) producing a second aqueous dispersion liquid containing a core particle;

(3) mixing the first aqueous dispersion liquid and the second aqueous dispersion liquid to adhere the resin fine particle to a surface of the core particle; and (4) heating the mixed dispersion liquid at a temperature equal to or more than a glass transition point of a resin constituting the resin fine particle to stick the resin fine particle to the surface of the core particle to form a protrusion.

* * * * *